US005259314A

United States Patent [19]

Sugiyama

[11] Patent Number: 5,259,314

[45] Date of Patent: Nov. 9, 1993

[54] PLATE MOUNTING APPARATUS FOR PRINTING PRESS

[75] Inventor: Hiroyuki Sugiyama, Ibaraki, Japan

[73] Assignee: Komori Corporation, Tokyo, Japan

[21] Appl. No.: 897,602

[22] Filed: Jun. 10, 1992

Related U.S. Application Data

[63] Continuation of Ser. No. 621,345, Dec. 3, 1990, abandoned.

[30] Foreign Application Priority Data

Dec. 6, 1989 [JP] Japan ..... 1-315382
Dec. 6, 1989 [JP] Japan ..... 1-315383
Dec. 6, 1989 [JP] Japan ..... 1-315384

[51] Int. Cl.[5] ..... B41F 27/00

[52] U.S. Cl. ..... 101/477; 101/415.1; 101/DIG. 36

[58] Field of Search ..... 101/141, 216, 378, 382.1, 101/383, 415.1, 477, 481, 485, 486, DIG. 36; 33/617, 618, 620, 621

[56] References Cited

U.S. PATENT DOCUMENTS 2,276,012 3/1942 Blackley ..... 101/415.1
3,614,926 10/1971 Brechtel ..... 101/415.1
3,793,950 2/1974 Kaneko et al. ..... 101/141
3,858,513 1/1975 Murata ..... 101/415.1
4,191,105 3/1980 Ohlsson ..... 101/415.1
4,727,807 3/1988 Suzuki et al. ..... 101/415.1
4,936,212 6/1990 Moss ..... 101/415.1

FOREIGN PATENT DOCUMENTS 73850 4/1985 Japan ..... 101/415.1
62-62759 8/1987 Japan .
63-191636 8/1988 Japan .

*Primary Examiner*—Edgar S. Burr
*Assistant Examiner*—Stephen R. Funk
*Attorney, Agent, or Firm*—Blakely, Sokoloff, Taylor & Zafman

[57] ABSTRACT

A plate mounting apparatus for a printing press for winding a plate (89, 105) around the circumferential surface of a plate cylinder (1), the plate (89, 105) having one end fixed to one fixing unit (5) arranged in a gap (2) in the circumferential surface, and for fixing the other end of the plate (89, 105) to the other fixing unit (30) arranged in the gap (2) in the circumferential surface, includes a guide roller (125) and a press roller (118). The guide roller (125) opposes the circumferential surface of the plate cylinder (1) and corresponds to one fixing unit (5) at the time of insertion of the plate into one fixing unit (5). The press roller (118) is detachably supported on the circumferential surface of the plate cylinder (1) and brought into rolling contact with the circumferential surface so as to correspond to the other fixing unit (30) at the time of insertion of the plate into the other fixing unit (30).

3 Claims, 10 Drawing Sheets

PLATE MOUNTING APPARATUS FOR PRINTING PRESS

This is a continuation of application Ser. No. 07/621,345, filed Dec. 3, 1990, now abandoned.

BACKGROUND OF THE INVENTION

The present invention relates to a plate mounting apparatus for a printing press, wherein one end of a plate is gripped by one fixing unit arranged in a gap in an outer circumferential surface of a plate cylinder, the plate is wound around the outer circumferential surface of the plate cylinder, and the other end of the plate is gripped by the other fixing unit to mount the plate on the plate cylinder, and an old plate is removed from the plate cylinder upon a change in specifications of printed matters and a new plate is mounted in place of the old plate.

A gap having almost a rectangular section and a length almost equal to the overall length of a plate cylinder is formed in the outer circumferential surface of the plate cylinder for a sheet-fed printing press. A plate lockup apparatus consisting of a leading-side lockup device serving as a fixing unit for fixing one end of a plate and a trailing-side lockup device serving as a fixing unit for fixing the other end of the plate is axially fixed on the bottom surface of the gap.

Each of the conventional leading- and trailing-side lockup devices comprises an elongated lockup table extending in the axial direction of the plate cylinder, a plurality of gripper plates, swingably supported at an edge portion of this lockup table by a plurality of bolts, for gripping or releasing the plate with or from the lockup table, and a plurality of cams which can be respectively engaged with gaps at the edges of the gripper plates. The plurality of cams are pivotally aligned along the axis. A plurality of compression coil springs are interposed between the lockup table and the gripper plates to bias the gripper plates in an open direction.

With the above arrangement, in order to mount a plate on a plate cylinder, when a cam shaft of the leading-side lockup device is pivoted, the gripper plates which are divided in the axial direction of the plate are released upon disengagement from the cams and are simultaneously opened by the elastic forces of the compression coil springs. An end of the plate is inserted between the leading-side lockup device and the corresponding lockup table. When the cam plate is pivoted in the direction opposite to the direction described above, the gripper plates are pivoted against the elastic forces of the compression coil springs by the behavior of the cams and are closed, thereby gripping the leading edge of the plate.

Another conventional apparatus is disclosed in Japanese Patent Laid-Open No. 1-127346. In this apparatus, the lockup tables and the gripper plates are disposed in the radial direction of a plate cylinder so that a trailing-side gripper surface of the plate conventionally formed in the circumferential direction of the plate cylinder is formed in the radial direction of the plate cylinder. The edge of the plate is bent at a right angle by an external bending machine. With this arrangement, after the leading edge of the plate is gripped, the bent portion of the trailing edge portion of the plate wound around the circumferential surface of the plate is inserted between the lockup tables and the gripper plates. The gripper plates are swung by a cam mechanism to grip the bent portion of the plate. The trailing-side lockup device as a whole is circumferentially moved to uniformly mount the plate, thereby bringing the plate into tight contact with the surface of the plate cylinder.

In such a conventional press, when an old plate is replaced with a new plate due to changes in contents of printed matters, the trailing-side cam shaft is pivoted to open the trailing-side lockup device. One end of the plate which is released from gripping is kept held, and the plate cylinder is rotated. The leading-side cam shaft is pivoted to open the leading-side lockup device to release the other end of the plate from gripping, thereby removing the old plate. Thereafter, opening/closing of the plate lockup devices and the pivotal operation of the plate cylinder are repeated to mount the new plate. In plate replacement, however, pivotal movement of the cam shaft and rotation of the plate cylinder must be performed manually or upon operation of a push button. Plate replacement is cumbersome and requires skills since the old and new plates must be manually held.

As disclosed in Japanese Patent Laid-Open No. 62-169647, a plate removal apparatus is proposed wherein a suction pad supported on a support member is brought to come close to a plate cylinder and to chuck an end of a plate to remove the plate.

In such a conventional plate mounting apparatus for mounting a plate on a plate cylinder, it is difficult to insert a plate into a narrow opening of the leading-side plate lockup device, thus resulting in time-consuming, cumbersome operations. Since the plate guided toward the trailing-side lockup device is not brought into tight contact with the circumferential surface of the plate cylinder, it is difficult to insert the trailing end bent at almost a right angle into the opening of the trailing-side plate lockup device, thus requiring a more time-consuming, cumbersome operation and much labor.

A plate supply apparatus for supplying a plate to a plate cylinder is proposed, as disclosed in Japanese Patent Laid-Open No. 58-187355 or the like. This plate supply apparatus comprises an arm having a suction pad fixed at its distal end portion. A plate mounting leading-side hook and a plate mounting trailing-side hook are mounted in the plate cylinder.

When a plate is mounted on the circumferential surface of the plate cylinder by using the plate supply apparatus described above, the arm having the suction pad which chucks the plate is moved between a plate mounting position and the leading-side hook in the circumferential portion of the plate cylinder to hook one bent portion of the plate against the leading-side hook. The plate is then wound around the circumferential surface, and the other bent portion of the plate is hooked against the trailing-side hook.

In an apparatus for manually attaching/detaching a plate of all the conventional plate mounting apparatuses, however, it is difficult to insert a plate into the narrow opening of the leading-side plate lockup device, thus requiring time-consuming, cumbersome operations and much labor. In addition, since the plate guided to the trailing-side plate lockup device is not brought into tight contact with the circumferential surface of the plate cylinder while being wound around the plate cylinder, it is difficult to insert the trailing end of the plate which is bent at almost a right angle into the opening of the trailing-side plate lockup device, thus requiring a more time-consuming, cumbersome operation and much labor.

In the apparatus for chucking the end of the plate by the suction pad, the structure becomes complicated, and a suction error tends to occur, thus failing to assure safety and reliability.

As described above, in the apparatus for hooking the bent portion of the plate against the hooks in the plate cylinder, it is difficult to bring the plate into tight contact with the circumferential surface of the plate cylinder. In addition, the structure is undesirably complicated.

SUMMARY OF THE INVENTION

It is an object of the present invention to provide a plate mounting apparatus for a printing press, capable of improving productivity and reducing labor.

It is another object of the present invention to provide a plate mounting apparatus for a printing press, capable of improving plate positioning.

It is still another object of the present invention to provide a plate mounting apparatus for a printing press, capable of facilitating maintenance and inspection and improving operability.

It is still another object of the present invention to provide a plate mounting apparatus for a printing press, capable of improving safety and reliability.

It is still another object of the present invention to provide a simple, compact plate mounting apparatus for a printing press.

In order to achieve the above objects of the present invention, there is provided a plate mounting apparatus for a printing press for winding a plate around a circumferential surface of a plate cylinder, the plate having one end fixed to one fixing unit arranged in a gap in the circumferential surface, and for fixing the other end of the plate to the other fixing unit arranged in the gap in the circumferential surface, comprising a guide roller which opposes the circumferential surface of the plate cylinder and corresponds to one fixing unit at the time of insertion of the plate into one fixing unit, and a press roller which is detachably supported on the circumferential surface of the plate cylinder and brought into rolling contact with the circumferential surface so as to correspond to the other fixing unit at the time of insertion of the plate into the other fixing unit.

According to the first aspect of the present invention, the plate cylinder is stopped at a position where a plate fixing surface of a fixing unit for fixing one end of a plate is positioned almost on a tangent of a guide roller, and the fixing surface is opened to insert one end of the plate into this opening. In this case, it is easy to insert the plate if it is inserted while it is kept in sliding contact with the guide roller. After one end of the plate is inserted, the fixing surface is closed, and the plate cylinder is pivoted. The plate is guided to the other fixing unit and is inserted into its opening. During this operation, the plate is brought into tight contact with the circumferential surface of the plate cylinder by the guide roller and is wound around the circumferential surface. The plate is then inserted into the opening by the press roller set in the mounted state. Therefore, the plate is brought into tight contact with the circumferential surface of the plate cylinder and can be easily inserted into the fixing units.

According to the second aspect of the present invention, in a plate holding unit arranged to support the guide and press rollers, the guide and press rollers are stored together with the plate holding unit to be largely away from the plate cylinder during the printing operation. Therefore, inspection, maintenance, and ink replenishing can be facilitated.

According to the third aspect of the present invention, prior to plate replacement, when an old plate gripping unit is naturally moved to a standby position and an actuator is operated with a push button or the like, the unit as a whole is kept stopped at the standby position. The trailing-side fixing unit in the plate cylinder is located to oppose the plate holding unit, and this fixing unit is operated. When the plate cylinder is pivoted, the old plate is removed into the plate holding unit. When the insertion end of this plate passes by a detector, the actuator is operated in response to a signal from the detector, thereby releasing the old plate gripping unit. The old plate gripping unit is moved by a tension of a spring member, so that the plate is entirely stored in the unit.

According to the fourth aspect of the present invention, prior to mounting of a plate onto a plate cylinder, the plate is chucked by a large number of suction pads formed on the surface of the plate holding unit, and a plate reference hole is engaged with a reference pin on the plate holding unit. The plate cylinder is pivoted and stopped so that the plate gripping surface of the leading-side plate lockup device is located almost on a line extending from the suction pads. The gripper surface is opened, and the holding unit which holds the suction pads is moved to the plate cylinder. A linearly formed leading end of the plate is inserted into the open plate gripping surface. The gripper surface is closed so that one end of the plate is gripped by the leading-side plate lockup device. When the plate cylinder is rotated by almost one revolution, the trailing end of the plate opposes to the plate gripper surface of the trailing-side plate lockup device, and the other end of the plate is inserted into the open plate gripper surface of the trailing-side plate lockup device. When the gripping surface is closed, the plate is mounted on the plate cylinder. Thereafter when the trailing-side plate lockup device is moved in the circumferential direction of the plate cylinder to keep the plate taut, the plate is brought into tight contact with the circumferential surface of the plate cylinder. Since the two ends of the plate are firmly gripped by the corresponding plate lockup devices, the plate can be kept taut with a sufficient tension.

BRIEF DESCRIPTION OF THE DRAWINGS

FIGS. 1 to 12H show a plate mounting apparatus for a printing press according to an embodiment of the present invention, in which:

FIG. 1 is a plan view of a plate cylinder;

FIG. 2 is a sectional view of the plate cylinder along the line II—II in FIG. 1;

FIG. 3 is a sectional view of the plate cylinder along the line III—III in FIG. 1;

FIG. 4 is a sectional view of the plate cylinder along the line IV—IV in FIG. 1;

FIG. 5 is a sectional view of the plate cylinder along the line V—V in FIG. 1;

FIG. 6 is a longitudinal sectional view of a trailing-side plate lockup device before a plate is gripped;

FIG. 7 is a side view of a plate lockup device opening/closing unit;

FIG. 8 is a partially cutaway side sectional view showing an upper half of a plate holding unit;

FIG. 9 is a partially cutaway side sectional view showing a lower half of the plate holding unit;

FIG. 10 is a side view of the plate holding unit;

FIG. 11 is a schematic side view showing an overall structure of the plate holding unit; and FIGS. 12A to 12H are schematic side views showing the overall structure of the plate holding unit and the main part to explain plate replacement operations.

DESCRIPTION OF THE PREFERRED EMBODIMENT

Figure 1:
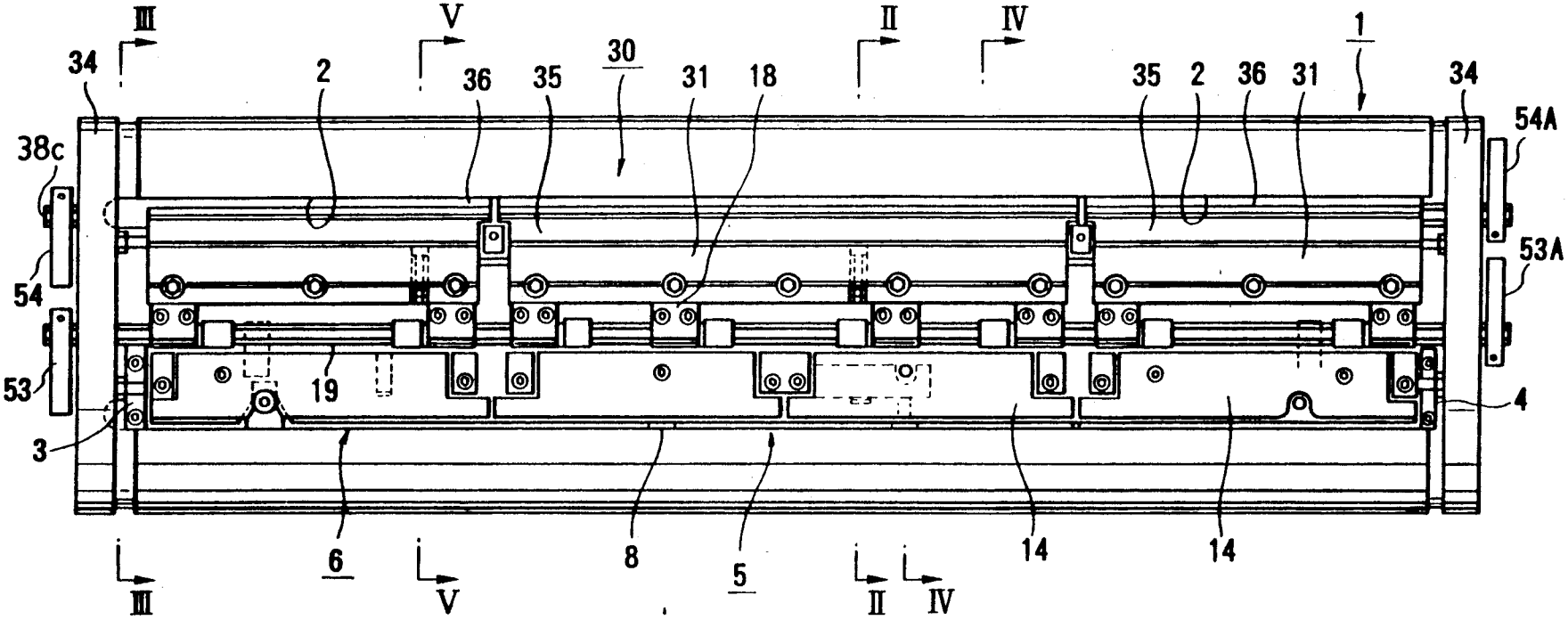
Figure 2:
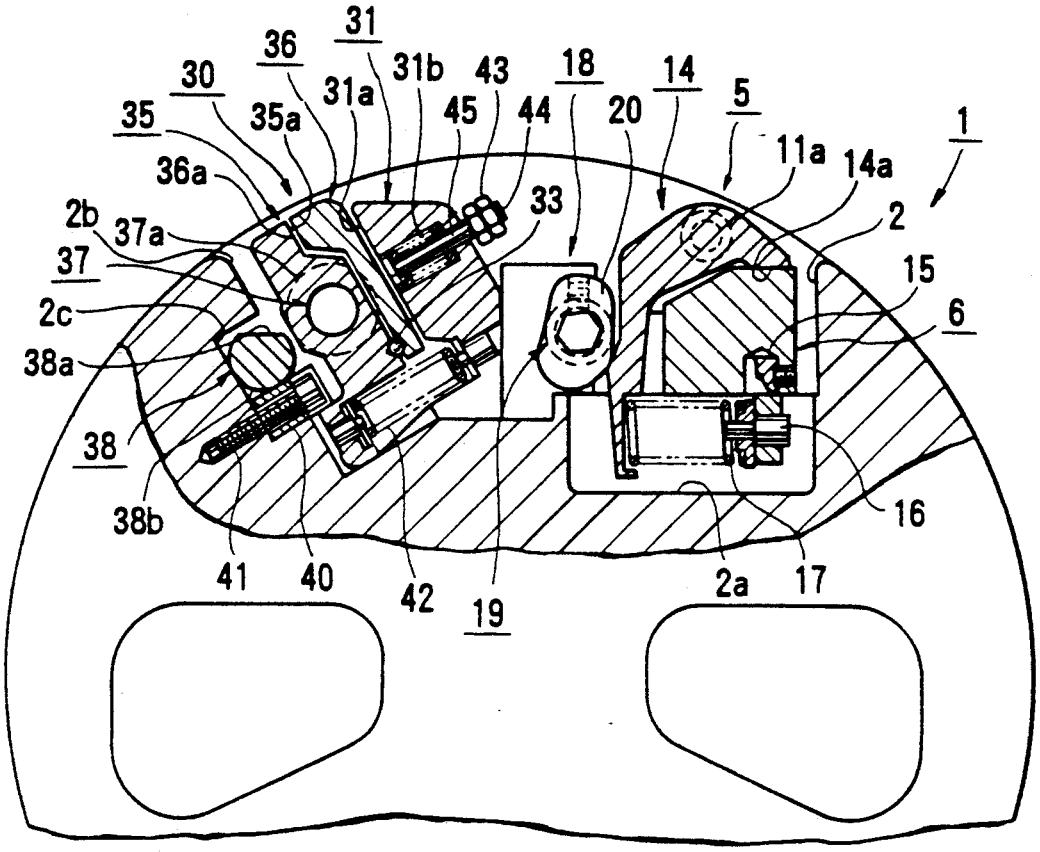
Figure 3:
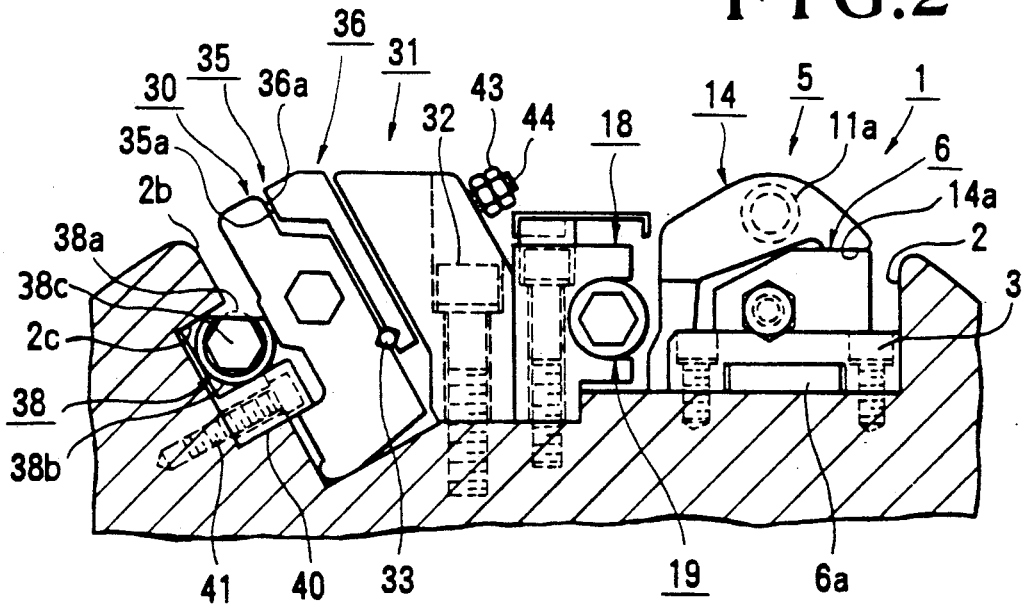
Figure 4:
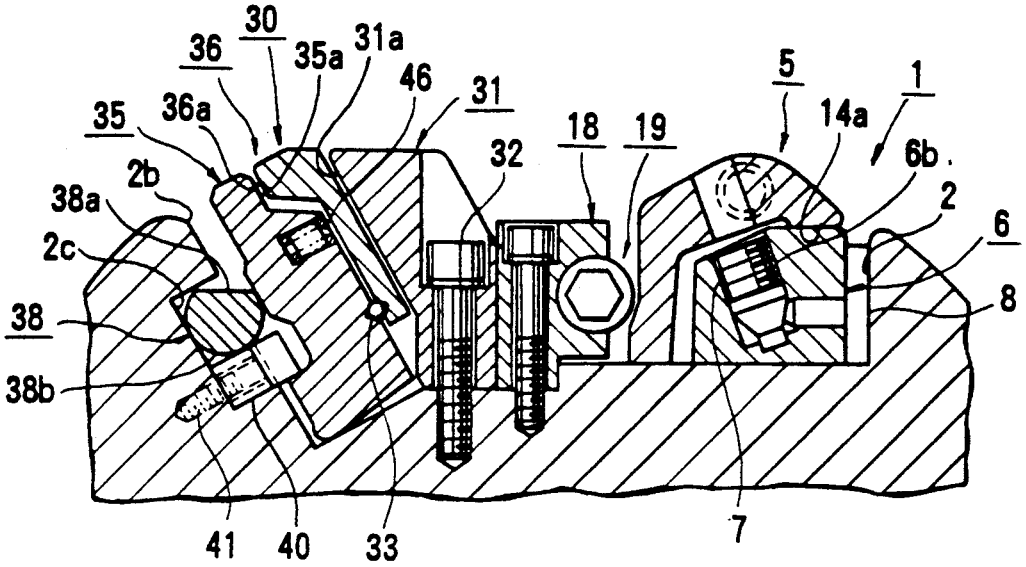

FIGS. 1 to 12H show an embodiment in which a plate mounting apparatus according to the present invention is employed in an automatic plate replacing apparatus.

A gap 2 having a substantially rectangular sectional shape is formed in the outer circumferential surface of a plate cylinder 1 along the entire length of the plate cylinder 1. Saddle-like guides 3 and 4 are bolted on the bottom surface portions of the gap 2 at its two ends. A leading-side plate lockup device 5 serving as one fixing unit comprises a lockup table 6 having an almost square sectional shape and extending in the axial direction of the plate cylinder. Thin-walled portions 6*a* at the two ends of the lockup device 6 are fitted to be slightly circumferentially movable while their vertical movement is restricted by the left and right guides 3 and 4. An intermediate portion of the lockup table 6 is slidably pressed by a plurality of guides (not shown) fixed on the bottom surface of the gap 2, so that floating of the lockup table 6 is prevented. A plurality of screw holes 6*b* are formed in portions along the longitudinal direction of the lockup table 6 and each has a section shown in FIG. 4. An adjusting screw 7 whose distal end is tapered is threadably engaged with a corresponding one of the screw holes 6*b*. A collared pin 8, the collar portion of which is fitted between the lockup table 6 and the gap 2, is slidably inserted in each pin hole corresponding to each of the adjusting screws 7. The distal end of the collared pin 8 abuts against a tapered surface of the corresponding adjusting screw 7. With this arrangement, when the adjusting screw 7 is turned, the lockup table 6 is slightly moved in the circumferential direction by the behavior of the tapered surface. A compression coil spring 9 in FIG. 5 is inserted between a stud 10 on the lockup table 6 and the wall surface of a recessed hole 2*a* of the gap 2 to bias the lockup device 5 outward.

Figure 5:
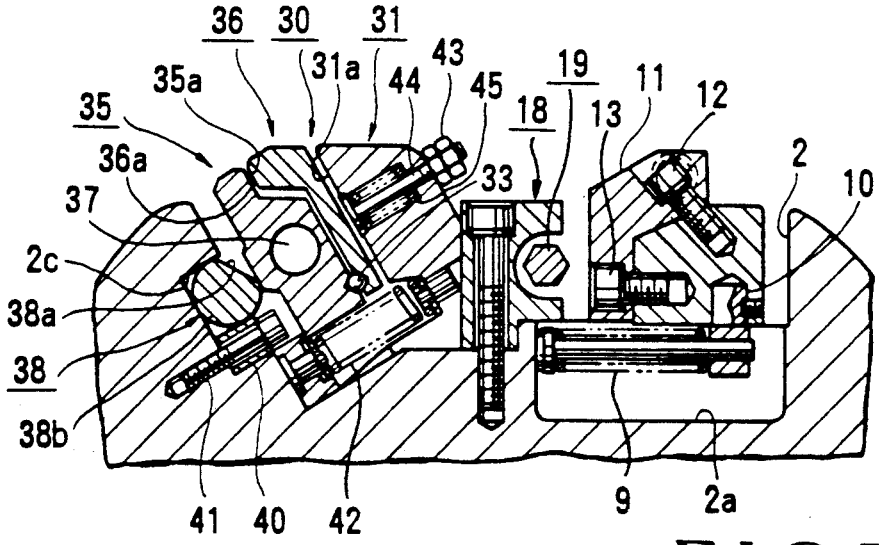
Figure 6:
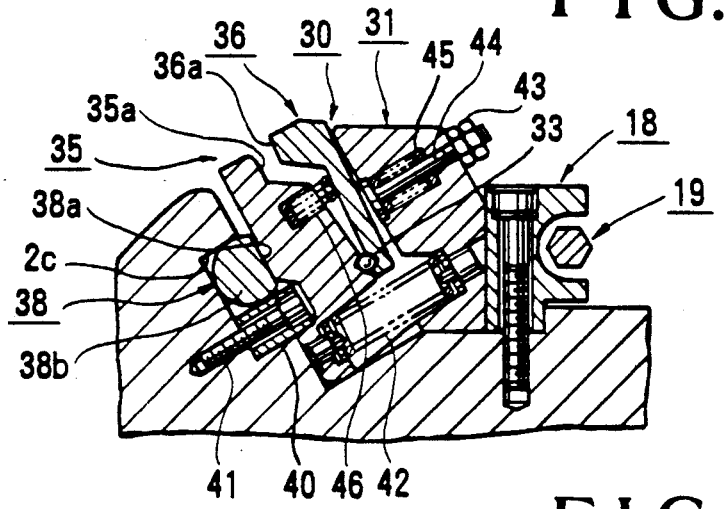

An L-shaped leading-side plate holder 11 shown in FIG. 5 is fixed by bolts 12 and 13 on the inclined surface of the lockup table 6. Three gripper plates 14 having a substantially V-shaped section, divided in the axial direction of the plate cylinder, and constituting the same overall length as that of the lockup table 6 are swingably supported on pins 11*a* horizontally extending from the plate holders 11. A gripper surface 14*a* of each gripper plate 14 opposes the gripper surface of the lockup table 6. Although not shown, a plurality of projections are formed on the gripper surface 14*a* and are engaged with the recesses formed in the opposite gripper surface. A plurality of studs 15 each having a sectional shape shown in FIG. 2 extend upward from the bottom surface of the lockup table 6 and are aligned in the axial direction of the plate cylinder to extend into the recessed hole 2*a* of the gap 2. A compression coil spring 17 is inserted between a spring reception pin 16 threadably engaged with a screw hole of each stud 15 and the gripper plate 14 to bias the gripper plate 14 in a direction so that the gripper surface 14*a* of the gripper plate 14 is closed.

A plurality of bearings 18 having a rectangular parallelepiped shape are fixed by bolts at the central part of the bottom surface of the gap 2 and are aligned along the axial direction of the plate cylinder. A hexagonal cam shaft 19 is fitted in the bearings 18. A plurality of plate gripper cams 20 each having large- and small-diameter portions are mounted on the cam shaft 19 in tandem with each other. The cam surface of each plate gripper cam 20 is in contact with a vertical surface of the corresponding gripper plate 14. Upon driving of the cam shaft 19 by a drive unit (to be described later), the large-diameter portions of the plate gripper cams 20 cause the gripper plates 14 to pivot in the counterclockwise direction against the biasing forces of the compression coil springs 17, so that the gripper surfaces 14*a* are opened.

A trailing-side plate lockup device 30 serving as the other fixing unit is arranged parallel to the leading-side lockup device 5 within the gap 2. The trailing-end lockup device 30 comprises a spring reception bar 31 having almost the same length as the overall length of the plate cylinder and a vertical surface which is in contact with the vertical surface of the corresponding bearing 18. The spring reception bar 31 is fixed on the bottom surface of the gap 2 by a plurality of bolts 32. The spring reception bar 31 comprises a regulation surface 31*a* extending in the radial direction of the plate cylinder 1. A support shaft 33 extends between the regulation surface 31*a* and a wall surface 2*b* of the gap 2 so that the two ends of the support shaft 33 are located near disc bearers 34 at the two ends of the plate cylinder 1. Three separated lockup tables 35 and three separating gripper plates 36 have opposite gripper surfaces 35*a* and 36*a* extending in the radial direction of the plate cylinder 1 so that ends of the lockup tables 35 and the gripper plates 36 opposite to these gripper portions are swingably connected to each other through the support shaft 33. Reference numerals 37 denote adjusting screws for connecting the three separated lockup tables 35. Right- and left-hand threads are threadably engaged with screw holes of each lockup table 35. A tool is inserted into a hole of a collar portion 37*a* integrally formed between the two adjacent lockup tables 35 and is turned to adjust a distance between the adjacent lockup tables 35.

A rod-like cam 38 formed by a planar small-diameter portion 38*a* and an arcuated large-diameter portion 38*b* is pivotally mounted on the bearer 34 in a recessed portion 2*c* formed in the wall surface 2*b* of the gap 2. An extended portion 38*c* of the cam 38 from the bearer 34 has a hexagonal shape. Reference numberal 40 denotes a guide for pivoting the cam 38 and is fixed in the recessed portion 2*c* of the wall surface 2*b* by a bolt 41. Compression coil springs 42 are interposed between a plurality of spring hole bottom surfaces formed in the non-gripper ends of the lockup tables 35 and the plurality of spring hole bottom surfaces formed in the spring reception bar 31 to separate the lockup tables 35 from the spring reception bar 31. A compression coil spring 45 is interposed between the bottom surface of a spring hole 31*b* and a collar portion of a spring shaft 44 whose movement is limited by a double nut 43 slidably mounted in the spring hole 31*b* of the upper portion of the spring reception bar 31, and separates each gripper plate 36 from the spring reception bar 31. A compression coil spring 46 is arranged within the spring hole of the upper portion of each lockup table 35 to bias this lockup table 35 from the corresponding gripper plate 36. Reference numeral 47 denotes a blanket cylinder which is brought into rolling contact with the plate cylinder 1.

An opening/closing drive unit for pivoting the cam shaft 19 and the cam 38 to open/close each plate gripper surface will be described below. Each opening/closing drive unit is arranged near each of right and left frames 50 for supporting the plate cylinder 1 and the blanket cylinder 47. The right drive unit (the left-hand unit in FIG. 1 for illustrative convenience) on the right frame 50 when viewed from the sheet feeder will be described first. An air cylinder 51 serving as a drive unit is swingably supported on the upper end face of the frame 50 through a bracket 52. Levers 53 and 54 are split-fixed on the leading-side cam shaft 19 and the trailing side cam 38 between the bearer 34 and the frame 50. A link mechanism 55 is arranged between the air cylinder 51 and the levers 53 and 54. The distal end portion of a rod 57 connected to a piston rod 56 of the air cylinder 51 is connected to a free end portion of an L-shaped lever 59 pivotally supported on the upper surface of the frame 50 through a bracket 58. The lower end portion of a rod 60 whose upper end is connected to the other free end portion of the L-shaped lever 59 is connected to a free end portion of a lever 62 supported on a stud 61 of the frame 50. A lever 63 is formed integrally with the lever 62. A free end portion of the lever 63 is connected to one end of a roller lever 64. Reference numeral 65 denotes a lever shaft pivotally supported between the right and left frames so that axial movement of a lever 66 pivotally mounted thereon is limited. A free end portion of the lever 66 is supported by the central portion of the roller lever 64. That is, a four-joint link is constituted by the levers 63 and 66 and the roller lever 64. When the lever 62 is driven by the air cylinder 51 and is swung, the roller lever 64 is reciprocated together with the levers 63 and 66 in the radial direction of the plate cylinder 1. A roller 67 which is selectively brought into contact with the lever 53 or 54 in accordance with a pivotal phase of the plate cylinder 1 is mounted on the distal end portion of the roller lever 64. When the roller lever 64 is reciprocated, the lever 53 or 54 is pivoted about the cam shaft 19 or the cam 38 within the range between the solid line and the alternate long and short dashed line in FIG. 7.

In the right opening/closing drive unit, when the lever 53 is located at the position indicated by the solid line, the plate gripper surfaces of the leading-side lockup device 5 are closed. However, when the lever 54 is located at the position indicated by the solid line, the plate gripper surfaces of the trailing-side lockup device 30 are open.

Figure 7:
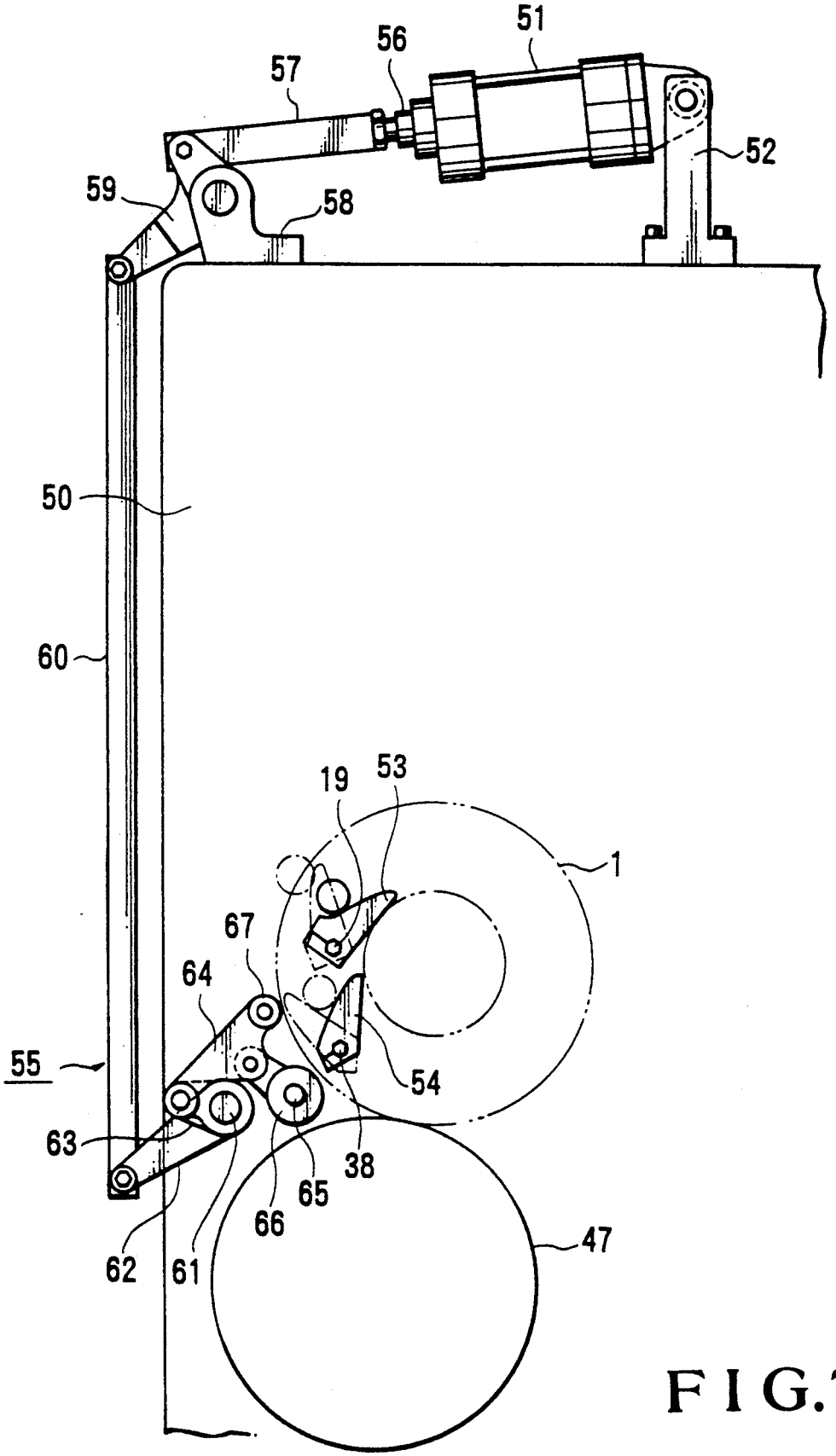
Figure 8:
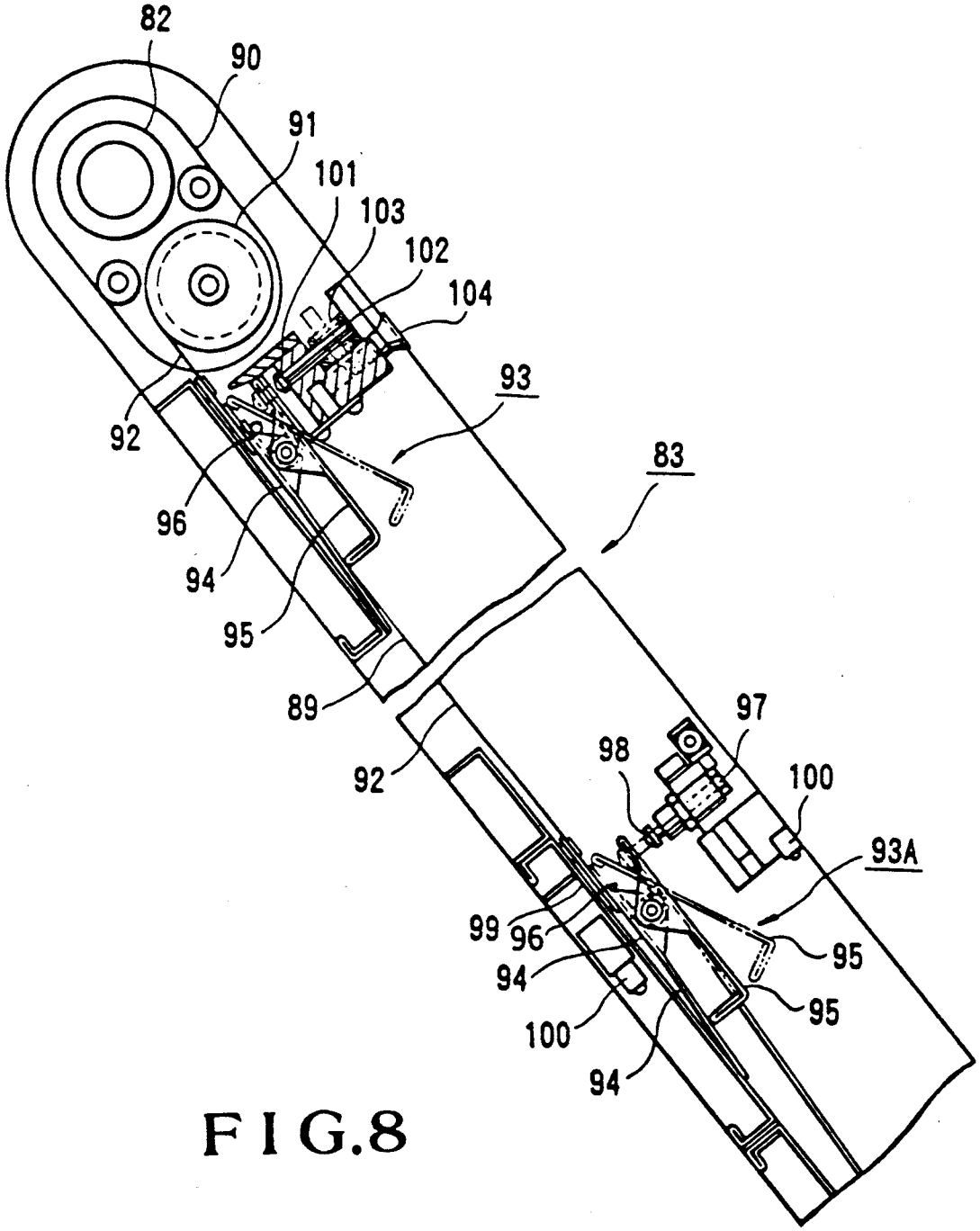

The left opening/closing drive unit (the right drive unit in FIG. 1) on the left frame side when viewed from the sheet feeder is arranged similarly to the right opening/closing drive unit, although the left opening/closing drive unit is not illustrated in FIG. 7. The arrangement of the left opening/closing drive unit is the same as that of the right opening/closing drive unit as far as the components from the air cylinder 51 to the roller 67 are concerned. The arrangement of the left opening/closing drive unit is different from that of the right opening/closing drive unit in levers 53 and 54. That is, as shown in FIGS. 1 and 7, the right levers 53 and 54 extend upward from the cam shaft 19 and the cam 38. However, in the left opening/closing drive unit, levers 53A and 54A in FIG. 1 extend downward from the cam shaft 19 and the cam 38. That is, the distal end portion of the right trailing-side lever 54 and the distal end portion of the left leading-side lever 53A are in phase in the circumferential direction and oppose the rollers 67. As a result, when the right and left air cylinders 51 are simultaneously actuated, the lever 54 is pressed by the right roller 67 to open the plate gripper surfaces of the trailing-side plate lockup device 30. At the same time, the left lever 53A is pressed by the left roller 67. At the same time, the right lever 53 is moved from the position of the solid line to the position of the alternate long and short dashed line, so that the plate gripper surfaces of the leading-side plate lockup device 5 are opened.

Figure 11:
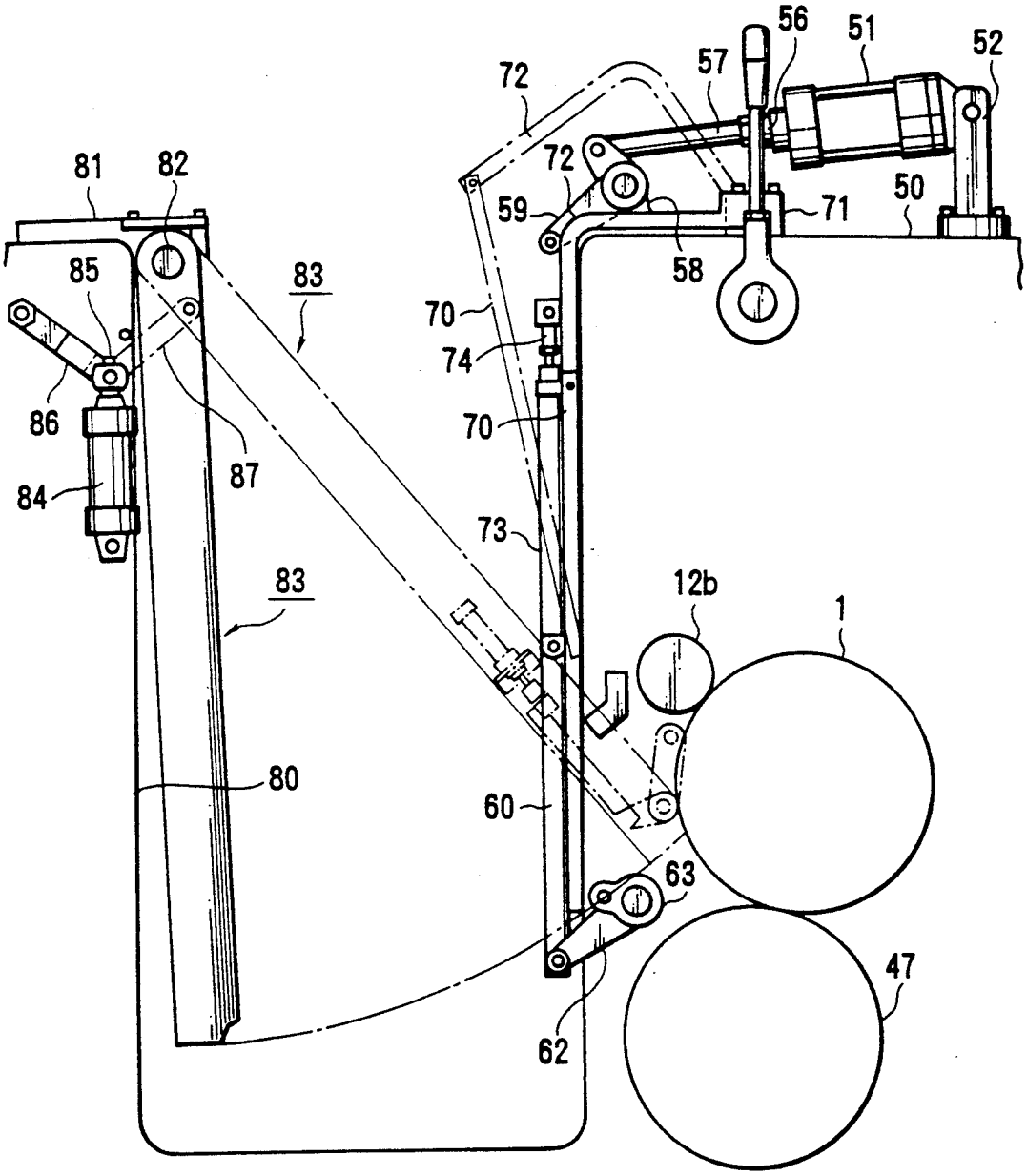

Reference numeral 70 in FIG. 11 denotes a cover for covering the front side of the plate cylinder 1 throughout its entire length. The cover 70 is pivotally supported on a free end portion of an L-shaped lever 72 pivotally supported on the upper end surface of the frame 50 through a bracket 71. An actuation end of a piston rod 74 of an air cylinder 73 pivotally supported on the frame 50 is mounted on the L-shaped lever 72. With this arrangement, when the air cylinder 73 is actuated in response to a command from a control unit, the cover 71 is moved in the range of the position indicated by the solid line and the position indicated by the alternate long and short dashed line.

A plate replacing apparatus for replacing an old plate with a new plate is arranged in the plate lockup apparatus and the opening/closing unit. That is, a pair of right and left brackets 81 are located obliquely above the plate cylinder 1 and are mounted on the upper ends of the rear sides of right and left frames 80 mounted in a printing unit in front of the frames 50. The proximal end of a loader 83 serving as a plate holding member having a rectangular member whose long sides are aligned in the horizontal direction and having almost the same length as the plate cylinder is mounted on a support shaft 82 pivotally mounted on these brackets 81. An air cylinder 84 connected to the control unit is pivotally supported on the right and left frames 80 near the brackets 81. A lever 86 supported by the frame 80 and a lever 87 supported on the loader 83 are connected to an actuation end of a piston rod 85 of the air cylinder 84. With this arrangement, when the piston rod 85 of the air cylinder 84 is reciprocated, the loader 83 is swung through the levers 86 and 87 between a suspended position indicated by the solid line and an inclined position indicated by the alternate long and short dashed line, so that the distal end portion of the loader 83 comes close to or is separated from the circumferential surface of the plate cylinder 1.

Figure 9:
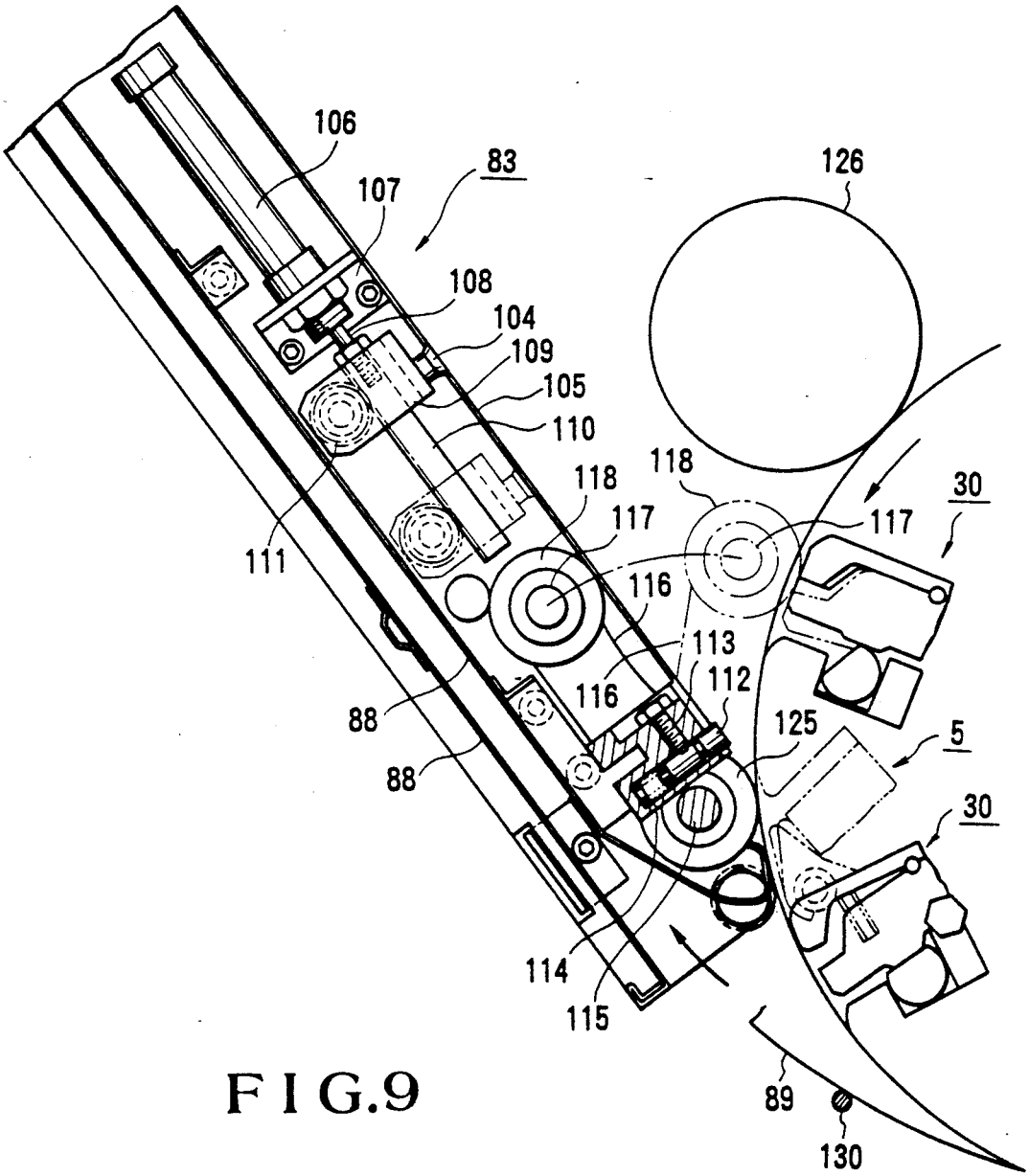
Figure 10:
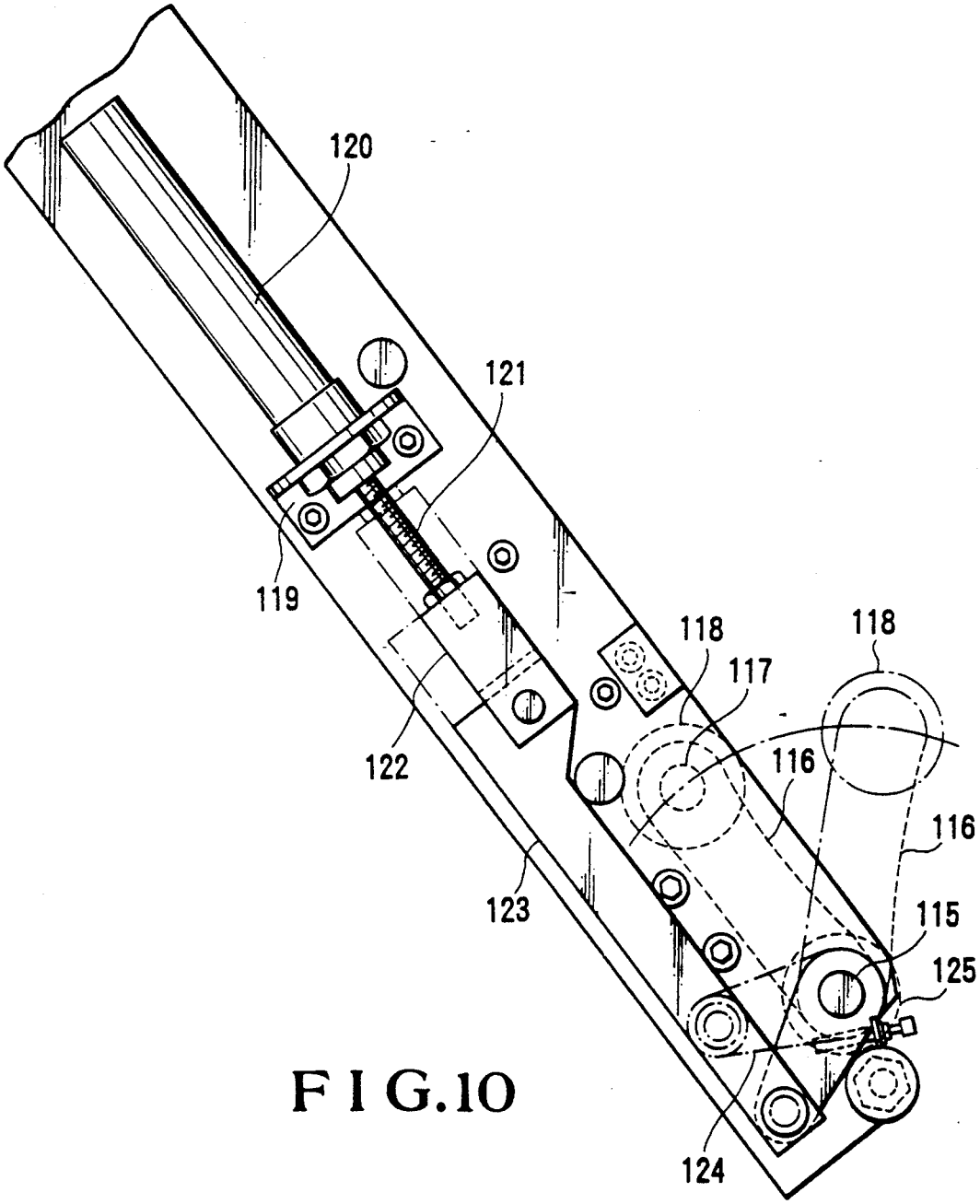

As shown in FIG. 9, two guide plates 88 having a V-shaped inlet vertically extend in the lower half of the loader 83. When the plate lockup device 30 is opened, a plate 89 released and rewound upon pivotal movement of the plate cylinder 1 is inserted between the guide plates 88 in a direction indicated by an arrow.

An old plate gripping unit arranged in the loader 83 will be described below. A plurality of pairs of brackets 90 each having an oval shape are fixed on the tubular support shaft 82 in the upper end portion of the loader 83 at positions obtained by dividing the overall width of the loader 83 into ⅓. Convex members 91 are supported on the respective pairs of brackets 90. Each convex member 91 has a tensive member in the form of a band-like leaf spring 92 biased in a direction to wind the convex 91. The fixed end of the leaf spring 92 is fixed to an old plate gripping unit 93. A support plate 94 fixed to the lower end of the leaf spring 92 can be slidably reciprocated along the inner wall surface of the loader. An L-shaped plate hook 95 serving as an old plate gripping member is pivotally supported at its center. The plate hook 95 is biased by a coil spring 96 so as to be held in an upright position (position of the solid line). A bent portion of the plate 89 entering between the guide plates 88 is hooked by a hook portion of the plate hook 95. That is, prior to the start of replacement of the plate 89, the old plate gripping unit 93 is manually moved downward to the central standby position of the loader 83, and a piston rod 98 of an air cylinder 97 arranged at this standby position is moved forward upon depression of a push button. The plate hook 95 is obliquely moved to be located at the position of the alternate long and short dashed line against the biasing force of the torsion coil spring 96. When the support plate 94 is urged against a cover 99 by the upper end of the plate hook 95, the old plate gripping unit 93 as a whole is prevented from upward movement by the tension of the leaf spring 92.

Reference numeral 100 denotes a sensor consisting of a light-emitting element and a light-receiving element and located near the air cylinder 97. The sensor 100 detects the leading edge of the plate 89 entering between the guide plates 88, and the piston rod 98 of the air cylinder 97 is moved backward to cause the plate hook 95 to stand against the elastic force of the torsion coil spring 96. The bent portion of the plate 89 is hooked by the plate hook 95, and at the same time, locking by the support plate 94 is released, so that the plate trailing edge holding unit 83 as a whole is moved upward together with the plate 89 by the tension of the leaf spring 92. Therefore, the plate 89 is pulled into the loader 83.

A pin 102 is slidably supported in a hole of a block 101 arranged in correspondence with the plate hook 95 at the upper end portion of the loader 83 and is biased in a direction to be removed from the block 101 by a compression coil spring 103. This pin 102 is pushed against the elastic force of the compression coil spring 103 to incline the upper end portion of the plate hook 95 as indicated by the alternate long and short dashed line, thereby releasing the bent portion of the plate 89. Therefore, the plate 89 can be removed from the loader 83.

A plate feed unit will be described below. Upper-, middle- (not shown), and lower-stage suction pads 104 (each stage consists of a plurality of pads) for chucking a new plate 105 to be fed to the plate cylinder 1 in place of the old plate 89 are connected to a suction air source and are arranged on the surface of the loader 83. The lower-stage suction pads 104 are vertically movable. That is, a pair of right and left air cylinders 106 are supported on both side plates of the loader 83 through brackets 107 above the lower-stage suction pads 104. The suction pads 104 are mounted in tandem with each other on a bar 109, both ends of which are fixed to piston rods 108 of the air cylinders 106. When the piston rods 108 are moved forward, the bar 109 which holds the new plate 105 is moved from a position indicated by the solid line to a position indicated by the alternate long and short dashed line, so that the new plate 105 is fed to the leading-side lockup device 5 which is open to the leading edge of the new plate 105. Reference numerals 110 denote racks fixed on the right and left side plates of the loader 83 and meshed with pinions 111 at the two ends of the bar 109 to smoothly move the bar 109 backward. Reference numeral 112 denotes a reference pin slidably fitted in a hole of another bar 113 and biased by a compression coil spring 114 to extend to be fitted in a reference hole of the new plate 105, thereby positioning the new plate 105.

An arm shaft 115 is pivotally supported at a lower end portion of the loader 83. A pair of right and left arms 116 are fixed on portions of the arm shaft 115 which extend from the loader 83. A stationary roller shaft 117 is supported between free end portions of the arms 116. A plurality of press rollers 118 made of, e.g., rubber or brushes are pivotally arranged on the roller shaft 117. A lever 123 is fixed through a connecting plate 122 to the actuation end of a piston rod 121 of an air cylinder 120 fixed to one widthwise end of the loader 83 through a bracket 119. The free end portion of a lever 124 fixed on the arm shaft 115 is mounted on the lower end portion of the lever 123. With this arrangement, when the piston rod 121 of the air cylinder 120 is reciprocated, the arm 116 can be pivoted in the range between a storage position indicated by the solid line in FIG. 9 and an in-operation position indicated by the alternate long and short dashed line. In the in-operation position indicated by the alternate long and short dashed line, the roller 118 is brought into tight contact with the new plate 105 on the plate cylinder 1, and the inner surface of the plate 105 is brought into tight contact with the outer circumferential surface of the plate cylinder 1. At the same time, the bent portion of the trailing edge of the new plate 105 is inserted into the open trailing-side lockup device 30. A plurality of guide rollers 125 made of, e.g., rubber or brushes are arranged in tandem with each other on the arm shaft 115 and are brought into slidable contact with the new plate 105 so as to guide it to the plate lockup device 5. Reference numerals 126 denote form rollers (generally at least four rollers) of an inking apparatus brought into contact with the plate surface on the plate cylinder 1 to apply an ink to the plate surface.

The units and apparatuses described above and a servo motor for rotating the plate cylinder 1 are connected through a control unit (not shown) and are operated at predetermined timings.

Figure 12A:
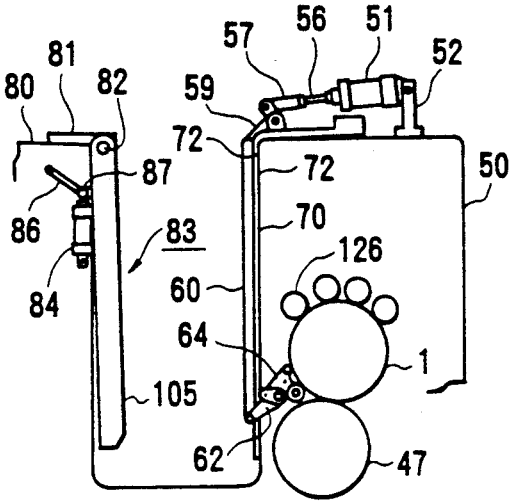
Figure 12B:
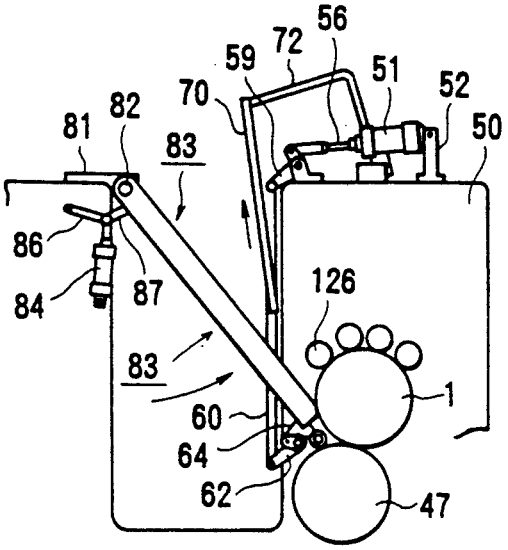

An operation of the plate mounting apparatus having the plate holding unit will be described below. During printing, as shown in FIG. 12A, the loader 83 is suspended from the support shaft 82. In this state, the new plate 105 is chucked by the upper-, middle-, and lower-stage suction pads 104, and the reference pin 112 is fitted in the reference hole, so that the new plate 105 is positioned and mounted in the loader 83. The old plate gripping unit 93 in the loader 83 is manually moved downward. When the air cylinder 97 is operated with the push button, the piston rod 98 is moved forward to urge the plate hook 95. The plate hook 95 is inclined as indicated by the alternate long and short dashed line in FIG. 8 and is thus opened. One end of the plate hook urges the support plate 94 against the inner surface of the cover 99, so that the apparatus is stopped at the standby position, and the plate hook 95 is inclined and opened to open the lower hook portion.

Figure 12C:
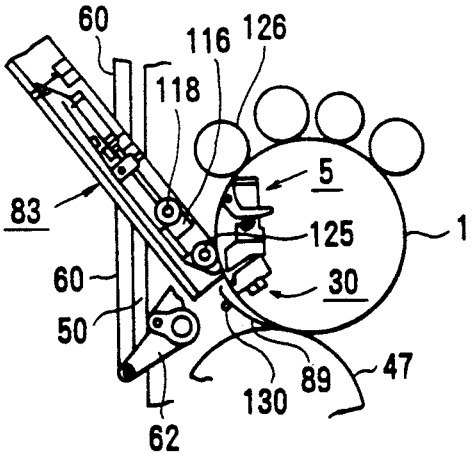

When printing is completed and the old plate 89 is to be replaced with the new plate 105, a start button is depressed. The air cylinder 73 is actuated to open the cover 70 through the L-shaped lever 72, as indicated by the alternate long and short dashed line in FIG. 11. At the same time, the air cylinder 84 is actuated to incline the loader 83 to a plate replacement position of FIG. 12B, through the levers 86 and 87. In this case, as shown in FIGS. 12C and 9, the trailing-side lockup device 30 oppose the distal end portion of the loader 83. At the same time, as shown in FIG. 7, the right roller 67 opposes the distal end portion of the lever 54 on the cam 38. The left roller 67 opposes the lever 53A on the cam shaft 19 which is in phase with the lever 54. In this state, when the right and left air cylinders 51 are simultaneously actuated, the leading- and trailing-side lockup devices 5 and 30 are simultaneously opened upon rotation of the cam 38 and the cam shaft 19.

Figure 12D:
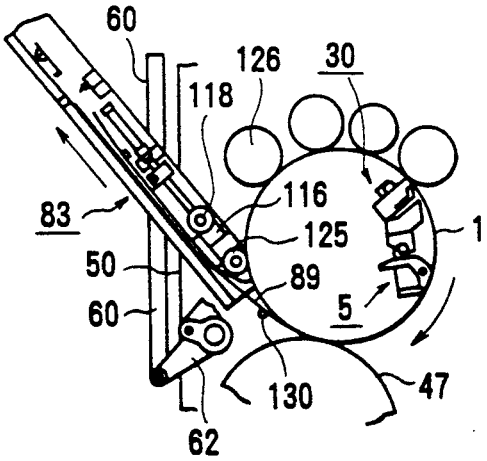

In this state, the trailing edge portion of the old plate 89 is popped up by its rigidity from the gripper surfaces of the trailing-side lockup device 30 and abuts against a guide 130, as shown in FIG. 12C. The plate cylinder 1 is pivoted in a direction opposite to the direction of the arrow in FIG. 9, so that the trailing edge of the old plate 89 is inserted between the guide plates 88 of the loader 83. When the inserted old plate 89 passes through the sensor 100, the sensor 100 detects the plate and drives the air cylinder 97, so that the piston rod 98 is moved backward. The plate hook 95 then stands up, as indicated by the solid line in FIG. 8. As a result, the plate hook 95 hooks the trailing-edge bent portion of the old plate 89, locking of the support plate 94 is released, and the old plate gripping unit 93 as a whole is moved upward by a tension accumulated by each leaf spring 92 arranged on the corresponding convex member 91. The old plate 89 held on the plate hook 95 is pulled and stored into the loader 83. FIG. 12D shows a state during removal of the old plate 89.

Figure 12E:
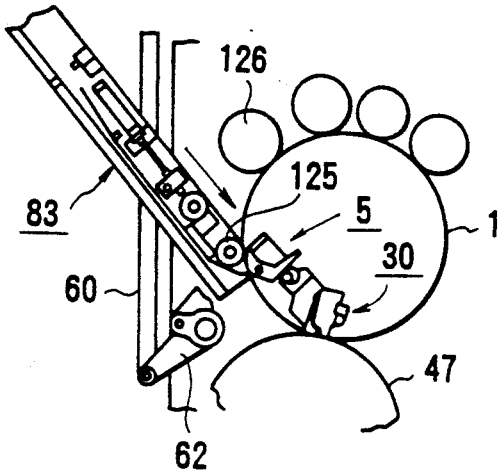

When the plate removal is completed, the servo motor is operated to slightly pivot the plate cylinder 1, and the plate cylinder 1 is stopped so that the open plate gripper surface of the leading-side lockup device 5 reaches a line extended from the new plate 105 and held on the loader 83, as shown in FIG. 9. At the same time, the air cylinder 106 is actuated to rotate the pinions 111 on the racks 110, so that the bar 109 is moved downward. The new plate 105 held by the lower-stage suction pads 104 is guided in slidable contact with the rollers 125 whose circumferential surfaces face a plate movement path. The leading edge of the new plate 105 is inserted into the leading-side lockup device 5. At this time, the lever 53 shown in FIG. 7 is located at the position of the alternate long and short dashed line and opposes the roller 67. When the air cylinder 51 is actuated, the cam shaft 19 is rotated together with the lever 53 to close the leading-side lockup device 5, and the new plate 105 is gripped by the leading-side lockup device 5. This state is shown in FIG. 12E.

Figure 12F:
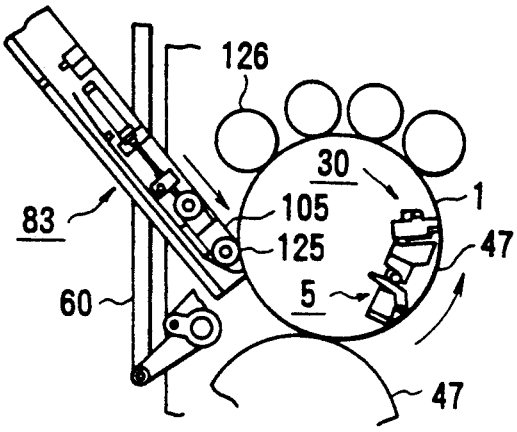
Figure 12G:
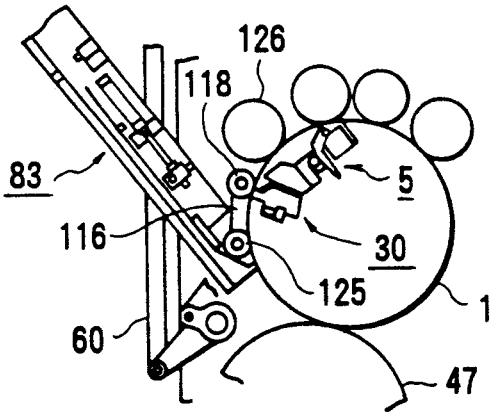

When the servo motor is operated in this state to pivot the plate cylinder 1 in the direction of the arrow, the new plate 105 is wound around the circumferential surface of the plate cylinder 1, and the trailing edge of the new plate 105 is stopped at a position corresponding to the roller 118. During rotation of the plate cylinder 1, the rollers 125 are rotated in rolling contact with the surface of the new plate 105. Therefore, the new plate 105 is brought into tight contact with the circumferential surface of the plate cylinder 1. Thereafter, the air cylinder 120 is actuated to move the piston rod 121 backward. The arm 116 is pivoted through the levers 123 and 124, and the rollers 118 made of, e.g., rubber or brushes are brought into tight contact with the circumferential surface of the plate cylinder 1, thereby inserting the trailing-edge bent portion of the new plate 105 into the trailing-side lockup device 30 by the press rollers 118. In this case, the trailing bent end portion of the new plate 105 is accurately aligned with the opening of the trailing-side plate lockup device 30 and is firmly gripped by this plate lockup device. FIG. 12F shows a state during rotation of the plate cylinder 1. FIG. 12G shows a state after rotation. When the trailing-edge end portion of the new plate 105 is inserted into the trailing-side plate lockup device 30, the left air cylinder is operated. In this case, the lever 54 has already been returned to the position indicated by reference numeral 54A. The roller urges the lever 54A downward, and the pivotal movement of the cam 38 causes closing of the trailing-side plate lockup device 30, thereby gripping the inserted end of the new plate 105. At the end of pivotal movement of the cam 38, the gripper plates 36 and the lockup tables 35 become integral with each other and move together in the circumferential direction of the plate cylinder 1. The new plate 105 is thus kept taut and is brought into tight contact with the circumferential surface of the plate cylinder 1.

Figure 12H:
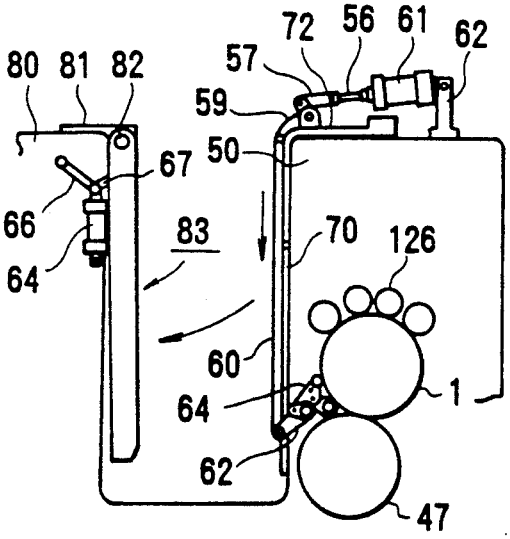

The air cylinder 120 is actuated to store the press rollers 118, and the piston rod 85 of the air cylinder 84 is moved backward to pull the levers 86 and 87. The loader 83 is moved downward to the stored state, as shown in FIG. 12H. The cover 70 is covered upon operation of the air cylinder 73. Therefore, printing can be restarted.

After printing is restarted, when the pin 102 is pushed at the front side of the loader 83 at a proper timing, the plate hook 95 is inclined to release the old plate 89. The old plate 89 is removed from the loader 83. As described above, the new plate 105 can be mounted on the loader 83 to stand by. A space between the printing units is not reduced in the stored state of the loader 83 and the press rollers 118.

The above embodiment exemplifies an automatic plate replacing apparatus. However, the present invention is not limited this. For example, a plate replacing apparatus may be driven upon operation of a push button or the like. The above embodiment also exemplifies a sheet-fed printing press, but is applicable to a rotary printing press to obtain the same effect as described above.

According to the first aspect of the present invention, as has been described above, in the plate mounting apparatus for a printing press, wherein the plate, one end of which is fixed to one fixing unit formed in the gap of the circumferential surface of the plate cylinder, is wound around the circumferential surface of the plate cylinder, and the other end of the plate is fixed to the other fixing unit formed in the gap of the circumferential surface of the plate cylinder, the guide roller opposing the circumferential surface of the plate cylinder and corresponding to one fixing unit at the time of insertion of the plate into this fixing unit for the plate, and the press roller detachably supported on the circumferential surface of the plate cylinder and opposing the circumferential surface of the plate cylinder so as to correspond to the fixing unit at the time of insertion of the plate into the other fixing unit are arranged. When the plate is to be inserted into one fixing unit at the time of mounting of the plate into the plate cylinder, the plate is inserted while being in sliding contact with the guide roller, thereby facilitating insertion, improving productivity, and reducing labor. In addition, the plate guided to the other fixing unit after it is wound around the circumferential surface of the plate cylinder is wound around the circumferential surface of the plate cylinder while being in tight contact therewith by the guide roller. Therefore, the plate is brought into tight contact with the circumferential surface of the plate cylinder, and the bent portion of the trailing end is caused to accurately correspond to the opening of the trailing side plate lockup device, thereby improving printing alignment precision.

According to the second aspect of the present invention, in the plate mounting apparatus for a printing press, the plate holding unit for holding a plate is arranged, and the plate holding unit is supported to be pivotal about a fulcrum of the printing press obliquely above the plate cylinder so that the distal end portion of the plate holding unit is reciprocated to come close to or to be away from the circumferential surface of the plate cylinder. The guide roller and the press roller are supported on the plate holding unit. During printing, the guide roller and the press roller can be stored to be largely away from the plate cylinder. Inspection, maintenance, and ink replenishment can be facilitated, thereby improving workability.

According to the third aspect of the present invention, the plate mounting apparatus for a printing press comprises the old plate gripping unit which is biased to a side opposite to the plate cylinder by the spring member, which is brought into sliding contact with the inner wall surface of the apparatus to be reciprocated therealong, and which is moved to the standby position located midway along the plate removal path against the spring force of the spring member, and the actuator which is fixed on the apparatus, which normally fixes the old plate gripping member to the standby position, and which releases the old plate gripping member from the standby position in response to a signal from the detector for detecting insertion of the old plate. The plate removed into the old plate holding unit is automatically and properly held at the standby position located midway along the old plate removal path, and is then stored in the old plate holding unit upon movement of the plate gripping unit biased by the spring member. Unlike in a support mechanism using the suction pads for holding the plate, the plate is not erroneously released from the pads, thereby improving safety and reliability, and reducing labor. At the same time, only one member is used to lock the old plate gripping member at the standby position and to keep the old plate gripping member open, thereby obtaining a simple, compact structure.

According to the fourth aspect of the present invention, the plate mounting apparatus for a printing press comprises the plate holding unit which is formed so that the plate fixing surface of the plate fixing unit arranged in the gap of the outer circumferential surface of the plate cylinder extends in the circumferential direction of the plate cylinder and which has a surface substantially even with the plate fixing surface outside the plate cylinder. The plurality of suction pads and the reference pin which engages with the reference hole in the plate are formed on the surface of the plate holding unit. At the same time, the suction pads are held by a holding means which is held between the plate holding units and reciprocated by the drive units in the radial direction of the plate cylinder, thus simplifying the structure as compared with a conventional structure. At the same time, the plate mounted in the plate cylinder is firmly gripped by the gripping surfaces of both the plate lockup devices. Therefore, the plate is kept sufficiently taut and brought into tight contact with the circumferential surface of the plate cylinder, thereby improving printing alignment precision.

What is claimed is:

1. A plate mounting apparatus for a printing press for winding a plate around a circumferential surface of a plate cylinder, said plate having one end removably coupled to one fixing unit arranged in a gap in said circumferential surface, and the other end of said plate removably coupled to the other fixing unit arranged in said gap in said circumferential surface, comprising:

a plate holding unit for holding said plate, said holding unit having a distal end portion, said holding unit being supported on said printing press obliquely above said plate cylinder;

a guide roller opposing said circumferential surface of said plate cylinder, said guide roller aligning said one end of said plate with said one fixing unit and guiding said one end of said plate for insertion into a plate lock-up device from said plate holding unit in a direction toward said circumferential surface;

a press roller selectively engaging said circumferential surface of said plate cylinder and brought into rolling contact with said circumferential surface so as to push said plate towards said other fixing unit only at the time of insertion of said plate into said other fixing unit; and drive means for reciprocating said distal end portion of said plate holding unit to come close to or to be away from said circumferential surface of said plate cylinder, said plate holding unit including first and second plate gripping means, independent of said guide roller and said press roller, for simultaneously holding both new and old plates, respectively, and wherein said guide roller and said press roller are supported on said plate holding unit.

2. A plate mounting apparatus for a printing press, comprising:

a plate holding unit for storing an old plate removed upon a pivotal movement of a plate cylinder, said plate holding unit being provided with a tensive member attached to a first side of said plate holding unit, an old plate gripping unit attached to said tensive member, wherein said old plate gripping unit is biased toward said first side away from said plate cylinder by said tensive member, said old plate gripping unit being displaced to a standby position located along a plate removal path against a tensive force exerted by said tensive member, a detector for detecting insertion of the old plate, and an actuator, fixed on said apparatus adjacent to the standby position, for normally fixing said old plate gripping unit to the standby position in response to a signal from said detector upon detecting insertion of the old plate.

3. A plate mounting apparatus for a printing press, said plate mounting apparatus comprising a plate fixing unit arranged in a gap of a circumferential surface of a plate cylinder, said plate fixing unit having a plate fixing surface, wherein said plate fixing surface extends in a circumferential direction of said plate cylinder, a plate holding unit arranged outside said plate cylinder and supported on said printing press obliquely above said plate cylinder, said plate holding unit having a distal end, a drive means for reciprocating said distal end of said plate holding unit so that a surface of said plate holding unit is substantialy even with said plate fixing surface when said distal end is displaced to a first position adjacent to said plate fixing surface, a delivery mechanism with suction means and a reference pin, said reference pin engaging a reference hole in a plate, said delivery mechanism formed on the surface of said plate holding unit, means for shifting said delivery mechanism so that the plate is delivered into said fixing surface in a direction substantially coplanar to said plate fixing surface, said plate holding unit including plate gripping means for simultaneously holding both new and old plates respectively.

* * * * *